US010611536B2

(12) United States Patent
Hokanson

(10) Patent No.: US 10,611,536 B2
(45) Date of Patent: Apr. 7, 2020

(54) DUAL END-CAP BUNDLE OF STACKED CONSUMER PRODUCTS

(71) Applicant: Kimberly-Clark Worldwide, Inc., Neenah, WI (US)

(72) Inventor: Brandon Mark Hokanson, Sheboygan Falls, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 148 days.

(21) Appl. No.: 15/777,108

(22) PCT Filed: Nov. 30, 2017

(86) PCT No.: PCT/US2017/063912
§ 371 (c)(1),
(2) Date: May 17, 2018

(87) PCT Pub. No.: WO2019/108192
PCT Pub. Date: Jun. 6, 2019

(65) Prior Publication Data

US 2020/0002072 A1 Jan. 2, 2020

(51) Int. Cl.
*B65D 71/22* (2006.01)

(52) U.S. Cl.
CPC ..... *B65D 71/22* (2013.01); *B65D 2571/0066* (2013.01); *B65D 2571/0079* (2013.01);
(Continued)

(58) Field of Classification Search
CPC ..... B65D 2571/010141; B65D 71/22; B65D 2571/0066; B65D 2571/0079; B65D 2571/00845
(Continued)

(56) References Cited

U.S. PATENT DOCUMENTS 2,998,181 A * 8/1961 Chasolen ..... B65D 21/08 229/117.07
3,376,994 A * 4/1968 Flinn, Jr. ..... B65D 9/32 220/6
(Continued)

FOREIGN PATENT DOCUMENTS

WO 04037659 A1 5/2004
WO 09131503 A1 10/2009
WO 10048357 A1 4/2010

OTHER PUBLICATIONS

Bensontyh, How to make a paper box packaging, www.boxtemplatesstore.com, Aug. 22, 2013, p. 1, Figure 1; p. 2, Para 1, http://boxtemplatesstore.com/2013/08/how-to-make-a-paper-box-packaging/.
(Continued)

*Primary Examiner* — Chun Hoi Cheung
(74) *Attorney, Agent, or Firm* — Kimberly-Clark Worldwide, Inc.

(57) ABSTRACT

A bundle of a stack of at least two consumer products is disclosed. The stack has opposite front and back faces spaced apart in a depth dimension, opposite top and bottom faces spaced apart in a height dimension, and opposite first and second end faces spaced apart in a length dimension. The bundle has a dual-cap bundling member that has a first end-cap that cups the stack at the first end-face, a second end-cap that cups the stack at the second end-face, and a bridge that integrally connects the first and second end-caps and that is superposed over the top face. The dual-cap bundling member is formed from a rigid substrate. The first end-cap and the second end-cap are not connected to each other via the rigid substrate other than by the bridge.

12 Claims, 10 Drawing Sheets

(52) U.S. Cl.
CPC ..... *B65D 2571/00141* (2013.01); *B65D 2571/00845* (2013.01)

(58) Field of Classification Search
USPC ..... 206/494, 152, 154, 425, 476, 485, 497
See application file for complete search history.

(56) References Cited

U.S. PATENT DOCUMENTS 4,146,127 A * 3/1979 Bayer ..... B65D 5/5042 206/294
4,381,058 A * 4/1983 Chaussadas ..... B65D 77/24 206/432
4,782,788 A * 11/1988 Arcand ..... A01K 1/0125 119/168
5,035,205 A * 7/1991 Schiller ..... A01K 1/0125 119/165
5,341,931 A * 8/1994 Prochaska ..... B65D 5/504 206/387.1
5,472,107 A * 12/1995 Lieber ..... B65D 1/225 220/6
D369,102 S * 4/1996 Pare ..... D9/415
5,765,693 A * 6/1998 Gnadt ..... B65D 73/0021 206/763
6,024,224 A * 2/2000 Gnadt ..... B65D 73/0021 206/763
D435,442 S * 12/2000 Candelin ..... D9/415
6,253,993 B1 7/2001 Lloyd
6,705,515 B2 3/2004 Dowd
7,172,110 B2 2/2007 Jackson
7,837,089 B2 11/2010 Pacheco
8,534,538 B2 9/2013 Fitzwater
9,540,132 B1 1/2017 Lee
2003/0205613 A1 11/2003 Schliebner
2005/0061861 A1 3/2005 Pennino
2006/0283924 A1 12/2006 McDaniel
2011/0048993 A1 3/2011 Gretzinger
2011/0101019 A1 5/2011 Maurice
2011/0147239 A1* 6/2011 Arkins ..... B65D 69/00 206/216
2011/0272458 A1 11/2011 Hardy
2012/0138489 A1 6/2012 Holley, Jr.
2013/0277420 A1 10/2013 Valencia
2015/0353266 A1 12/2015 Murphy
2016/0302626 A1 10/2016 D'Hiet

OTHER PUBLICATIONS

TEMCA GMBH, profix escon crêpé wiping cloth dispenser-boxes, www.europages.co.uk, Jun. 23, 2017, p. 1, Para 1, Figure 1, http://www.europages.co.uk/profix-escon-cr%C3%AAp%C3%A9-wiping-cloth-dispenser-boxes/TEMCA-GMBH/cpid-5362293.html?qs=wipes, Germany.

* cited by examiner

DUAL END-CAP BUNDLE OF STACKED CONSUMER PRODUCTS

BACKGROUND OF THE DISCLOSURE

Consumer products are often sold in multi-unit bundles. Common examples include two or more bars of soap, tubes of toothpaste, cartons of facial tissue, or flexible pouches of moist wipes. Various techniques exist to bundle the units together for sale, including a plastic film bag or overwrap, a cardboard box, and gluing the items together. These conventional methods in many instances suffer from deficiencies. For example, if it were desired to sell multiple units of a moist wipes flexible dispensing pouch with a rigid flip-open lid (representatively illustrated in FIG. 1), the above-listed techniques present various problems. Beginning with a stack of two wipes pouch units, wrapping the stack with a plastic film overwrap—and nothing more—will bundle the units, but the resulting bundle stack will lack consistently flat surfaces, making stacking for storage or retail display challenging and unsightly. A cardboard box would provide a consistently flat surface for stacking the stack, but cardboard is opaque and would conceal useful graphics which may be printed on the individual units, and a cardboard box encasing the individual units may be costly and wasteful. Finally, gluing the individual units together would in this case be impeded by the presence of the rigid flip-open lid, because the bottom surface of the pouch unit on top of the stack would sit atop the rigid flip-open lid of the pouch unit on the bottom of the stack.

What is needed is an improved method of bundling stacked consumer products that does not completely conceal the graphics of the individual product packaging, that provides sufficient shape and integrity to the bundle to enhance stacking and/or retail presentation, that is more cost-effective than a conventional corrugate or cardstock box, and that makes relatively sparing use of packaging raw material.

SUMMARY OF THE DISCLOSURE

A first embodiment of the invention includes a bundle of at least two consumer products, has a depth extending in a depth dimension, a height extending in a height dimension, and a length extending in a length dimension. The bundle includes a stack of at least two consumer products, the stack having opposite front and back faces spaced apart in the depth dimension, opposite top and bottom faces spaced apart in the height dimension, and opposite first and second end faces spaced apart in the length dimension. The bundle includes a dual-cap bundling member, the dual-cap member having a first end-cap that cups the stack at the first end-face, a second end-cap that cups the stack at the second end-face, and a bridge that integrally connects the first and second end-caps and that is superposed over the top face. The dual-cap bundling member is formed from a rigid substrate. The first end-cap and the second end-cap are not connected to each other via the rigid substrate other than by the bridge.

A second embodiment of the invention includes a bundle of at least two consumer products, the bundle having a depth extending in a depth dimension, a height extending in a height dimension, and a length extending in a length dimension, the bundle comprising: a stack of at least two consumer products, the stack having opposite front and back faces spaced apart in the depth dimension, opposite top and bottom faces spaced apart in the height dimension, and opposite first and second end faces spaced apart in the length dimension; a first end-cap that cups the stack at the first end face, and a second end-cap that cups the stack at the second end-face; and a bridge that connects the first and second end-caps and that is superposed over the top face, wherein the first end-cap, the second end-cap, and the bridge are all integrally formed from a rigid substrate, and wherein the first end-cap and the second end-cap are not connected to each other via the rigid substrate other than by the bridge.

A third embodiment of the invention includes either of the first or second embodiments, further wherein the first end-cap extends from the first end-face toward the second end-face no more than one-third of the bundle length, and wherein the second end-cap extends from the second end-face toward the first end-face no more than one-third of the bundle length.

A fourth embodiment of the invention includes any of the first through third embodiment, further wherein the first end-cap completely covers the first end-face, and wherein the second end-cap completely covers the second end-face.

A fifth embodiment of the invention includes a bundle of at least two consumer products, the bundle having a depth extending in a depth dimension, a height extending in a height dimension, and a length extending in a length dimension, the bundle comprising: a stack of at least two consumer products, the stack having opposite front and back faces spaced apart in the depth dimension, opposite top and bottom faces spaced apart in the height dimension, and opposite first and second end faces spaced apart in the length dimension; and a first end-cap having an first end-segment superposed over the first end face, a first front-face-segment superposed over the front face, a first back-face-segment superposed over the back face, and a first bottom-face-segment superposed over the bottom face, wherein the first front-face-segment, the first back-face-segment, and the first bottom-face-segment each extend integrally from the first end-segment, wherein the first end-segment at least partially covers the first end face, wherein the first front-face-segment has a length that extends in the length dimension and that is less than half of the bundle length; wherein the first back-face-segment has a length that extends in the length dimension and that is less than half of the bundle length; wherein the first bottom-face-segment has a length that extends in the length dimension and that is less than half of the bundle length; a second end-cap having an second end-segment superposed over the second end face, a second front-face-segment superposed over the front face, a second back-face-segment superposed over the back face, and a second bottom-face-segment superposed over the bottom face, wherein the second front-face-segment, the second back-face-segment, and the second bottom-face-segment each extend integrally from the second end-segment, wherein the second end-segment at least partially covers the second end face, wherein the second front-face-segment has a length that extends in the length dimension and that is less than half of the bundle length; wherein the second back-face-segment has a length that extends in the length dimension and that is less than half of the bundle length; wherein the second bottom-face-segment has a length that extends in the length dimension and that is less than half of the bundle length; and a bridge that connects the first and second end-caps and that is superposed over the top face, wherein the first end-cap, the second end-cap, and the bridge are all integrally formed from a rigid substrate, wherein the first end-cap is not connected to the second end-cap other than by the bridge.

A sixth embodiment of the invention includes any of the first through fifth embodiments, further wherein each consumer product is an individually wrapped, sealed package of moist wipes.

A seventh embodiment of the invention includes any of the first through sixth embodiments, further wherein each package of moist wipes is a flow-wrap package having opposite end seals, and wherein each end seal of each package of moist wipes is concealed by an end-cap.

An eighth embodiment of the invention includes any of the first through seventh embodiments, further wherein each package of moist wipes includes a rigid lid that covers a dispensing orifice, and wherein the bridge defines a cut-out region adapted to reveal the rigid lid.

An ninth embodiment of the invention includes any of the first through eighth embodiments, further wherein the rigid substrate is cardboard, cardstock, or corrugate.

A tenth embodiment of the invention includes any of the first through ninth embodiments, further wherein no part of the bridge is superposed over the front face, the back face, or the bottom face.

An eleventh embodiment of the invention includes any of the first through tenth embodiments, further wherein a transparent, flexible film is at least partially wrapped around the bundle.

A twelfth embodiment of the invention includes the eleventh embodiment, further wherein the film covers four, and only four, of the stack's front, back, top, bottom, first end, and second end faces.

A thirteenth embodiment of the invention includes the eleventh embodiment, further wherein the film covers at least a portion of each of the stack's front, back, top, bottom, first end, and second end faces.

A fourteenth embodiment of the invention includes any of the first through thirteenth embodiments, further configured such that the bottom face is adapted to face a store shelf and the front face is adapted to face a consumer during retail presentation in a store.

DETAILED DESCRIPTION OF THE DISCLOSURE

Figure 6:
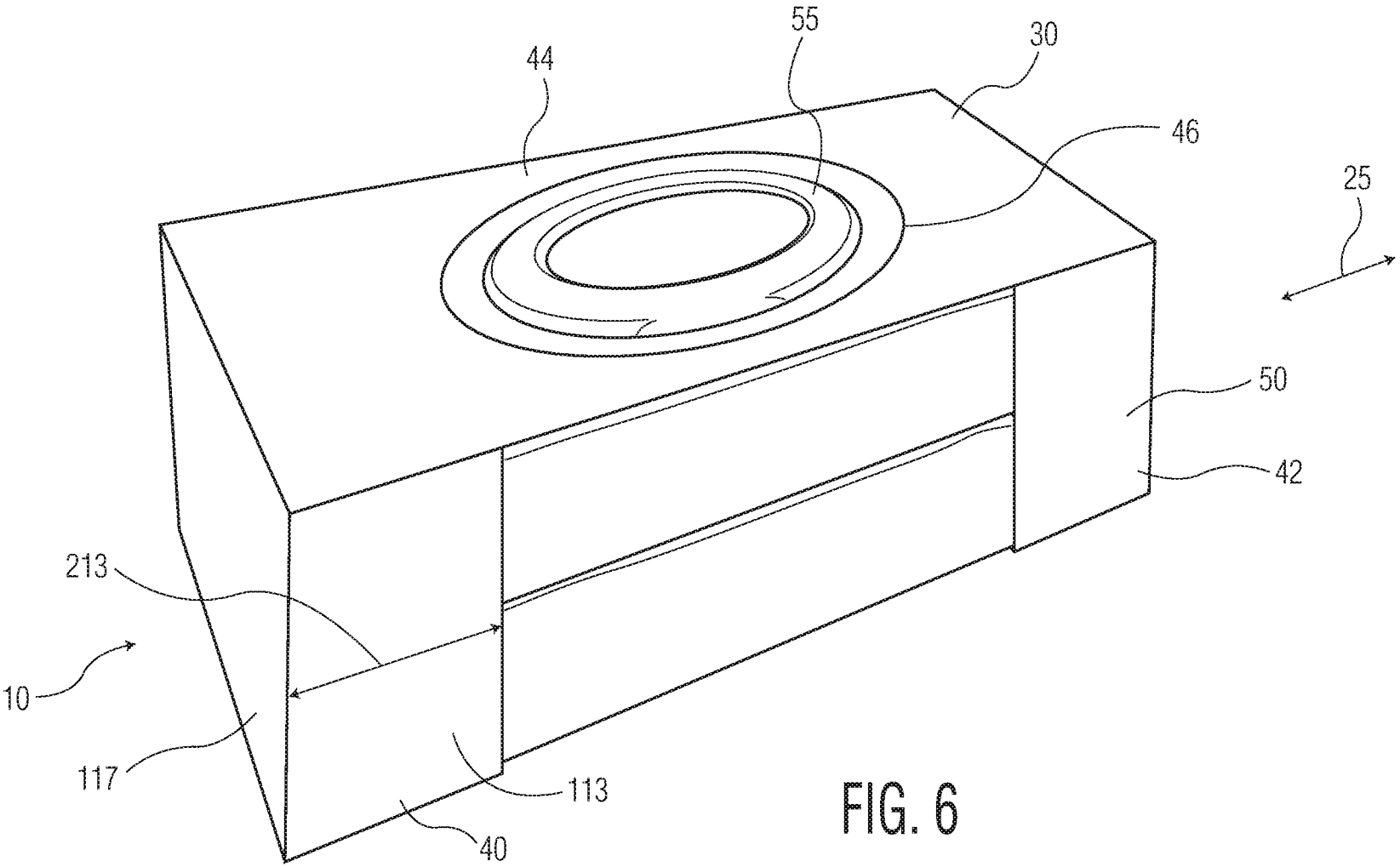
FIG. 6 representatively illustrates a bundle of a stack of packages in accordance with an alternative embodiment of the present invention, employing the bundling member of FIG. 7.

Referring to FIGS. 3 and 6, in particular embodiments, a bundle 10 of at least two consumer products 12 has a depth 20 extending in a depth dimension 21, a height 22 extending in a height dimension 23, and a length 24 extending in a length dimension 25. The bundle 10 includes a stack 11 of at least two consumer products 12, 12 (FIGS. 2A-2D). The stack 11 has opposite front and back faces 13, 14 spaced apart in the depth dimension 21, opposite top and bottom faces 15, 16 spaced apart in the height dimension 23, and opposite first and second end faces 17, 18 spaced apart in the length dimension 25. It should be noted that the terms "front," "back," "top," "bottom," and "end" are herein used arbitrarily to refer to the various faces of the stack 11, and do not indicate (unless specified) that a particular face bears a particular set of artwork or information, or must be positioned on shelf in a particular way. For example, "front face" as used herein does not necessarily refer to the face of the stack 11 that would face the store shopper, and "bottom face" as used herein does not necessarily refer to the surface of the stack 11 that would face the store shelf. In particular embodiments, the bundle 10 is configured such that the bottom face 16 of the stack 11 is adapted to face a store shelf, and the front face 13 of the stack 11 is adapted to face a consumer during retail presentation in a store.

Referring to FIGS. 3-8, in particular embodiments, the bundle 10 includes a dual-cap bundling member 30. The dual-cap bundling member 30 has a first end-cap 40 that cups the stack 11 at the first end-face 17, a second end-cap 42 that cups the stack 11 at the second end-face 18, and a bridge 44. The bridge 44 integrally connects the first and second end-caps 40, 42, and the bridge 44 is superposed over the top face 15 of the stack 11. The first end-cap 40 and the second end-cap 42 are not connected to each other via the rigid substrate other than by the bridge 44.

In particular embodiments, the first end-cap 40 extends from the first end-face 17 toward the second end-face 18 no more than one-third of the bundle length 24, and, similarly, the second end-cap 42 extends from the second end-face 18 toward the first end-face 17 no more than one-third of the bundle length 24, such as in the embodiments shown in FIGS. 3 and 6. Such a construction can be desirable because such relatively short end caps (that is, short in the length dimension 25) allow the stack 11 of products 12, 12 to be at least partially visible to a prospective purchaser, such as to reveal that the bundle includes at least two packages of product 12.

In particular embodiments, the bundle 10 includes a first end-cap 40 that cups the stack 11 at the first end face 17, and a second end-cap 42 that cups the stack 11 at the second end-face 18. A bridge 44 connects the first end-cap 40 to the second end-cap 42. The bridge 44 is superposed over the top face 15 of the stack 11. The first end-cap 40, the second end-cap 42, and the bridge 44 are all integrally formed from a rigid substrate. The first end-cap 40 and the second end-cap 42 are not connected to each other via the rigid substrate other than by the bridge 44.

In particular embodiments, the bundle 10 includes a first end-cap 40 having a first end-segment 117 superposed over the first end face 17, a first front-face-segment 113 superposed over the front face 13, a first back-face-segment 114 superposed over the back face 14, and a first bottom-face-segment 116 superposed over the bottom face 16. The first front-face-segment 113, the first back-face-segment 114, and the first bottom-face-segment 116 each extend integrally from the first end-segment 117. The first end-segment 117 at least partially covers the first end face 17. The first front-face-segment 113 has a length 213 (that extends in the length dimension 25 of the bundle 10) that is less than half, and preferably less than a quarter, of the bundle length 24. The first back-face-segment 114 has a length 214 (that extends in the length dimension 25 of the bundle 10) that is less than half, and preferably less than a quarter, of the bundle length 24. The first bottom-face-segment 116 has a length 216 (that extends in the length dimension 25 of the bundle 10) that is less than half, and preferably less than a quarter, of the bundle length 24.

Continuing with the same embodiment, the bundle 10 can further include a second end-cap 42 having a second end-segment 118 superposed over the second end face 18, a second front-face-segment 313 superposed over the front face 13, a second back-face-segment 314 superposed over the back face 14, and a second bottom-face-segment 316 superposed over the bottom face 16. The second front-face-segment 313, the second back-face-segment 314, and the second bottom-face-segment 316 each extend integrally from the second end-segment 118. The second end-segment 118 at least partially covers the second end face 18. The second front-face-segment 313 has a length 413 (that extends in the length dimension 25 of the bundle 10) that is less than half, and preferably less than a quarter, of the bundle length 24. The second back-face-segment 314 has a length 414 (that extends in the length dimension 25 of the bundle 10) that is less than half, and preferably less than a quarter, of the bundle length 24. The second bottom-face-segment 316 has a length 416 (that extends in the length dimension 25 of the bundle 10) that is less than half, and preferably less than a quarter, of the bundle length 24.

Finally, the embodiment includes a bridge 44 that connects the first end-cap 40 to the second end-cap 42. The bridge 44 is superposed over the top face 15 of the stack 11. The first end-cap 40, the second end-cap 42, and the bridge 44 are all integrally formed from a rigid substrate. The first end-cap 40 and the second end-cap 42 are not connected to each other via the rigid substrate other than by the bridge 44. In particular embodiments, no part of the bridge 44 is superposed over the front face 13, the back face 14, or the bottom face 16.

In particular embodiments, the first end-segment 117 completely covers the first end face 17 of the stack 11 (see FIGS. 3A, 3B, and 6), and the second end-segment 118 completely covers the second end face 18 of the stack 11. Such a construction can be desirable because the end caps thus conceal the end-faces 17, 18 of the stack 11, which may include unsightly, disheveled, or wrinkled packaging material, characteristics which would otherwise negatively affect the retail appearance of the bundle 10.

In particular embodiments, the first end-segment 117 is generally rectangular and defines a first front-edge 127, a first back-edge 137, a first bottom-edge 147, and a first top-edge 157. The first front-face-segment 113 is connected to the first end-segment 117 along an entirety of the first front-edge 127, the first back-face-segment 114 is connected to the first end-segment 117 along an entirety of the first back-edge 137, and the first bottom-face-segment 116 is connected to the first end-segment 117 along an entirely of the first bottom-edge 147. Similarly, the second end-segment 118 is generally rectangular and defines a second front-edge 128, a second back-edge 138, a second bottom-edge 148, and a second top-edge 158. The second front-face-segment 313 is connected to the second end-segment 118 along an entirety of the second front-edge 128, the second back-face-segment 314 is connected to the second end-segment 118 along an entirety of the second back-edge 138, and the second bottom-face-segment 316 is connected to the second end-segment 118 along an entirely of the second bottom-edge 148.

Figure 3A:
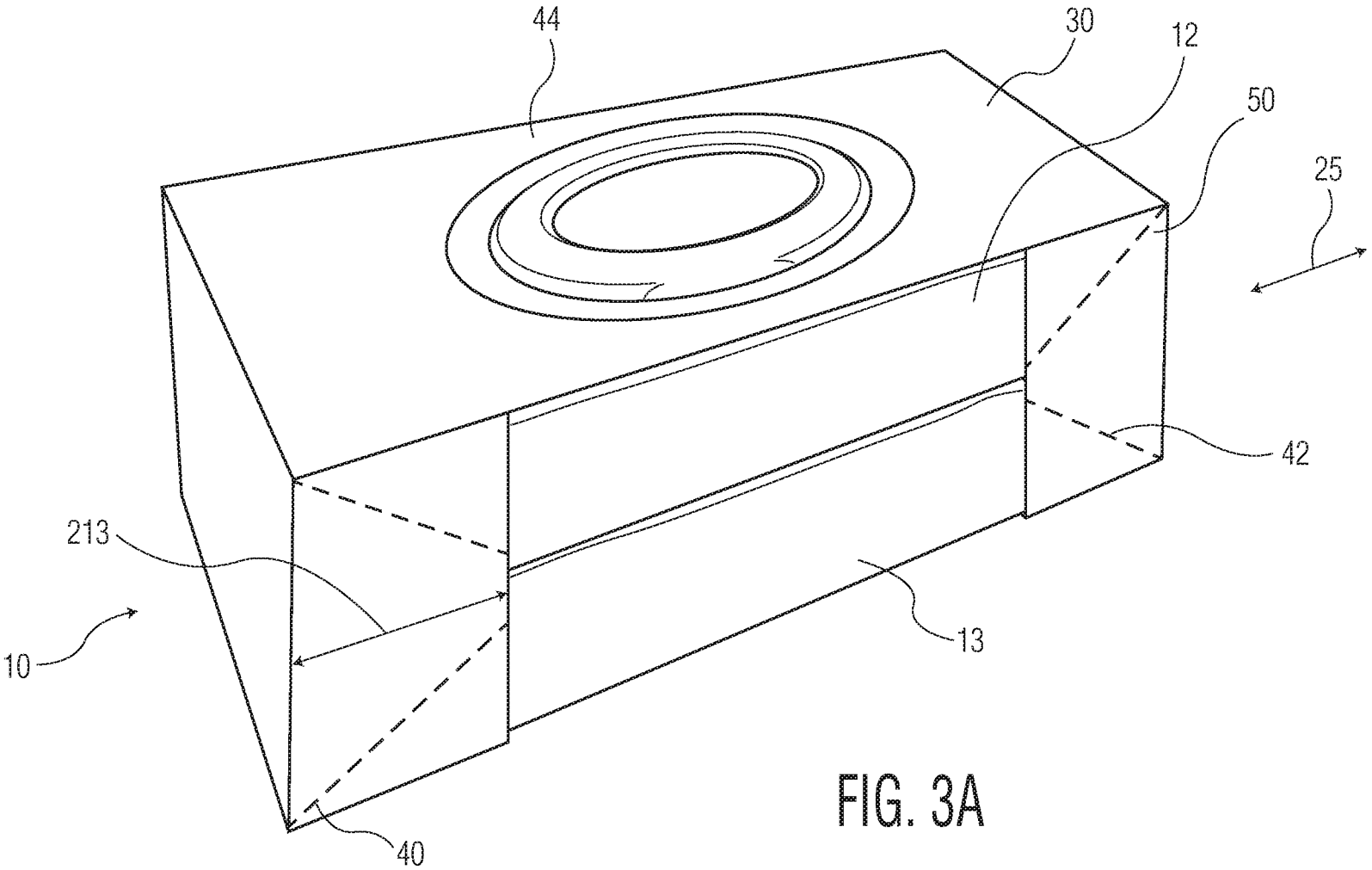
FIG. 3A representatively illustrates a bundle of a stack of packages in accordance with one embodiment of the present invention, employing the bundling member of FIG. 4.
Figure 3B:
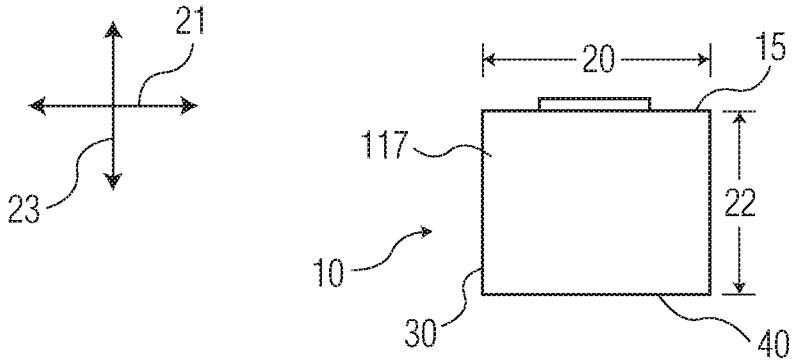
FIG. 3B representatively illustrates an end view of the bundle of FIG. 3A.
Figure 3C:
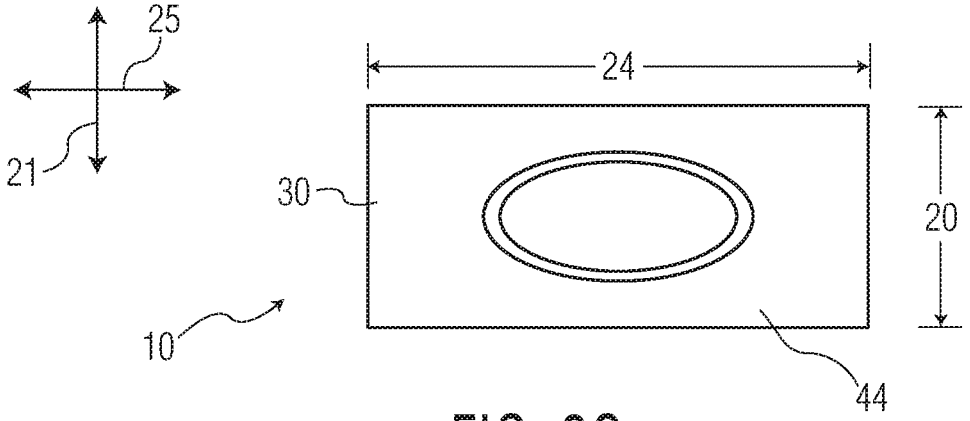
FIG. 3C representatively illustrates a top view of the bundle of FIG. 3A.
Figure 3D:
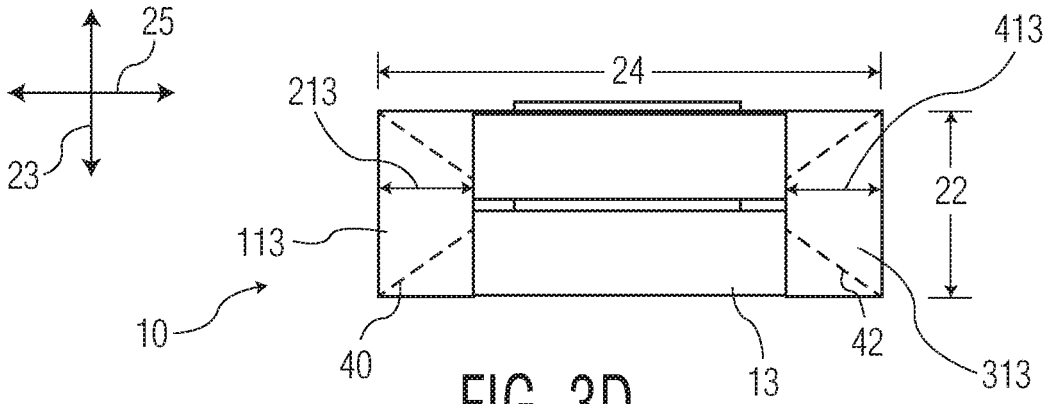
FIG. 3D representatively illustrates a front view of the bundle of FIG. 3A.
Figure 4:
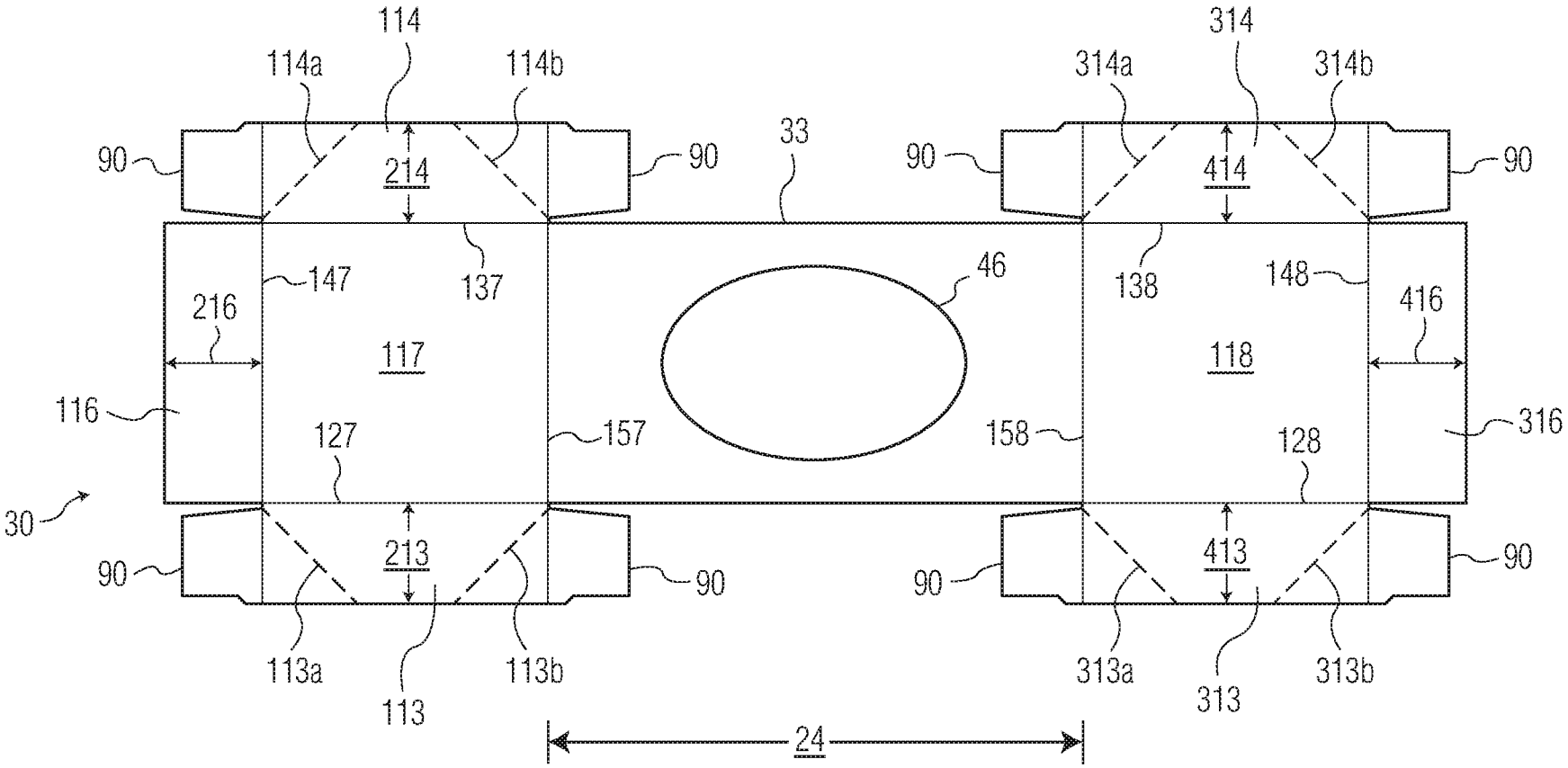
FIG. 4 representatively illustrates a plan view of a bundling member suitable for use in conjunction with particular embodiments of the present invention, shown in a laid-open, unfolded, and un-erected condition.
Figure 5A:
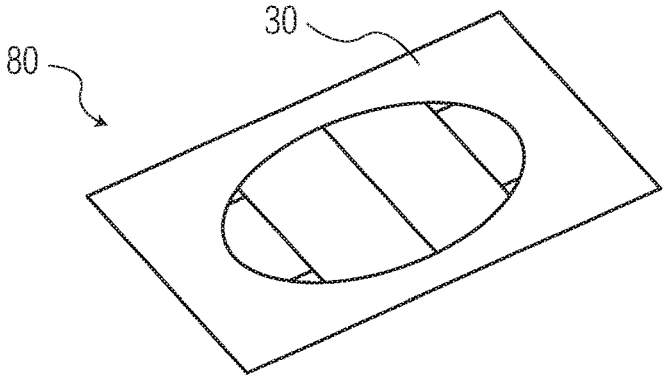
FIG. 5A shows the bundling member of FIG. 4 in a flat, folded, and fully collapsed configuration.
Figure 5B:
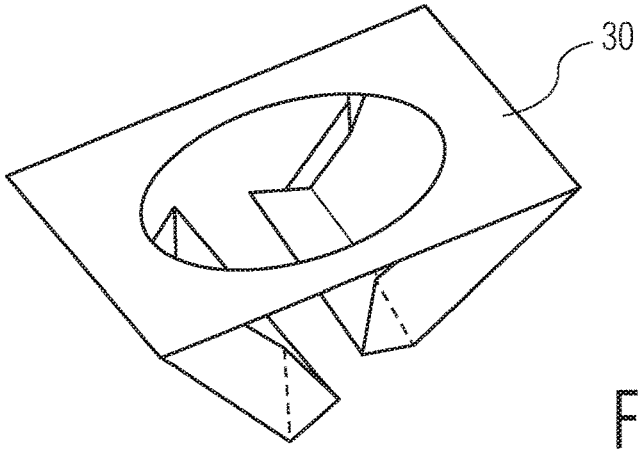
FIG. 5B shows the bundling member of FIG. 4 in a partially erected configuration.
Figure 5C:
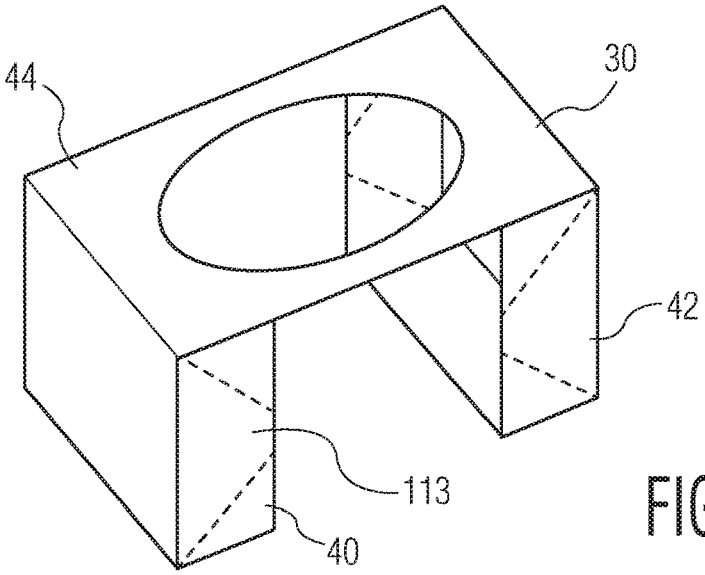
FIG. 5C shows the bundling member of FIG. 4 in a fully erected configuration.

In particular embodiments, the dual-cap bundling member 30 can be configured so that it may be provided in a substantially flat or collapsed configuration, and relatively easily converted to an erected configuration. FIGS. 5 and 8 show two different examples of such an approach. In the embodiment of FIG. 5, each front-face-segment 113, 313 includes two lines of weakness 113*a*, 113*b*, and 313*a*, 313*b*, oriented at approximately 45 degrees to the respective front-edge 127, 128, and each back-face-segment 114, 314 includes two lines of weakness 114*a*, 114*b*, and 314*a*, 314*b*, oriented at approximately 45 degrees to the respective back-edge 137, 138. Each line of weakness 113*a*, 113*b*, 313*a*, 313*b*, 114*a*, 114*b*, 314*a*, 314*b* is adapted to allow the respective front-face-segment 113, 313 or back-face-segment 114, 314 to collapse in upon the respective end-segment 117, 118 when the consumer products 12, 12 are not present. The bundling member 30 can be received by the packaging converter in a compact, flat configuration 80 (FIG. 5A). In particular embodiments, tabs 90 can be pre-tucked and even pre-glued into place to maintain the configurations shows in FIGS. 5A-5C. When picked up, the end caps 31, 32 tend in particular embodiments to automatically fold out (FIG. 5B). The end caps 31, 32 can then be straightened with modest manual adjustments (FIG. 5C) as the bundling member 30 is placed around the products 12, 12 (FIG. 3A).

Figure 7:
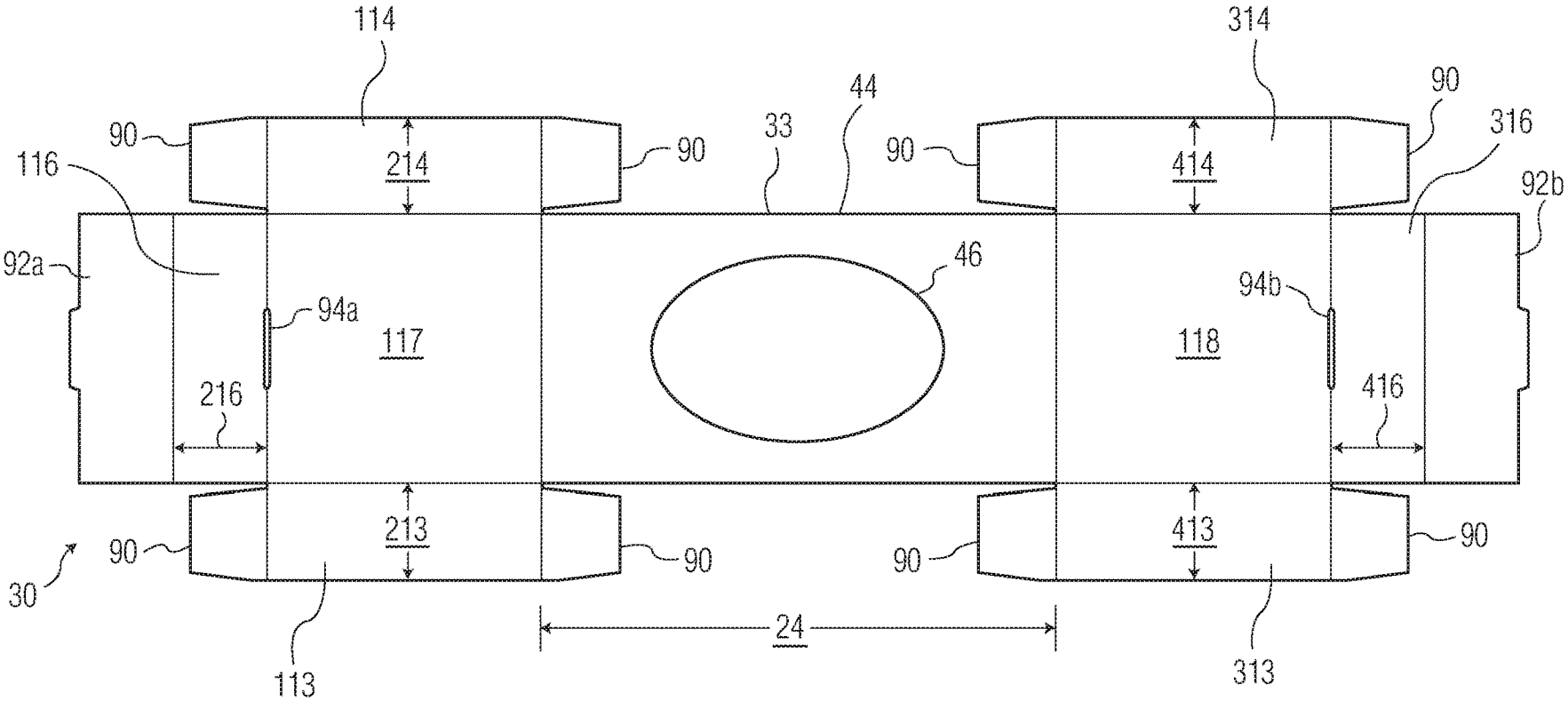
FIG. 7 representatively illustrates a plan view of a bundling member suitable for use in conjunction with particular embodiments of the present invention, shown in a laid-open, unfolded, and un-erected condition.
Figure 8A:
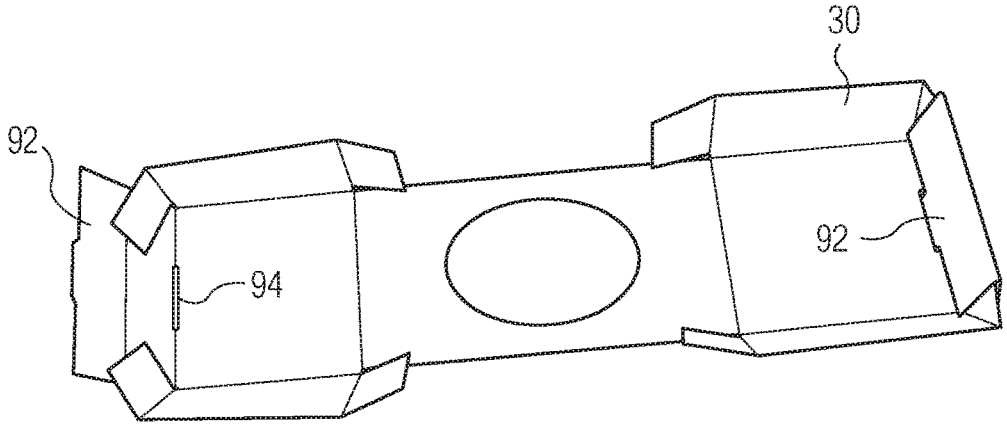
FIG. 8A shows the bundling member of FIG. 7 in a laid-open, partially folded, substantially un-erected condition.
Figure 8B:
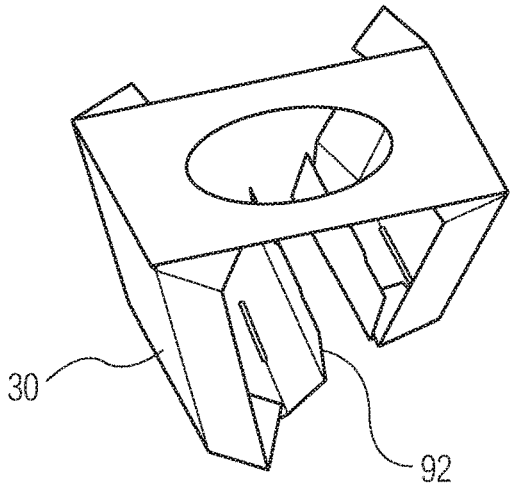
FIG. 8B shows the bundling member of FIG. 7 in a partially erected configuration.
Figure 8C:
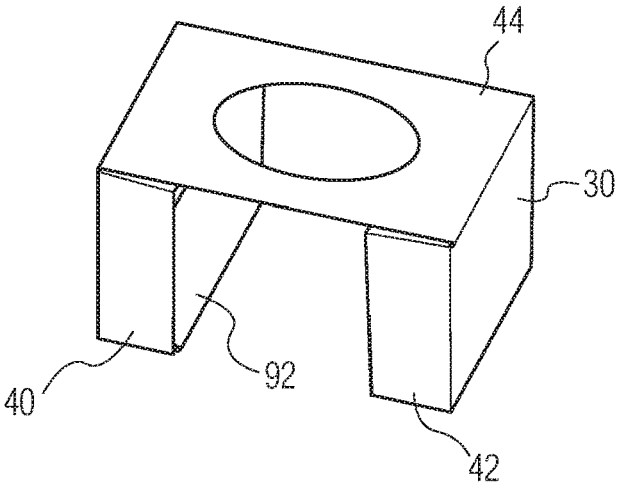
FIG. 8C shows the bundling member of FIG. 7 in a fully erected configuration.

In an alternative design, (FIGS. 6-8), the bundling member 30 includes a self-locking mechanism in which tuck tabs 92*a*, 92*b* can be tucked into slots 94*a*, 94*b* (FIGS. 7, 8A, and 8B). Such an approach in particular embodiments can obviate the need to use glue to hold the tabs 90 in place during erection of the bundling member 30 to the erected configuration (FIG. 8C).

Figure 1:
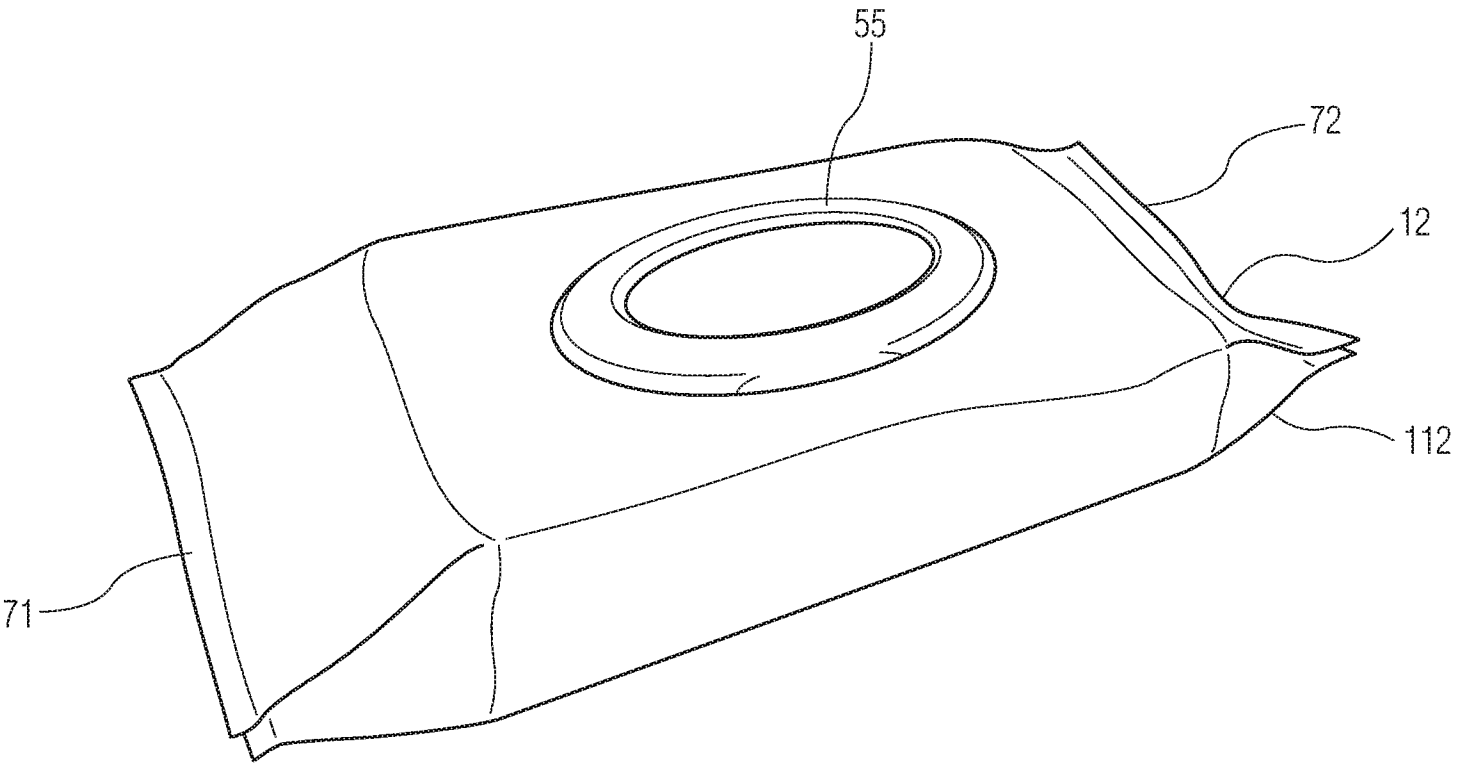
FIG. 1 representatively illustrates a package of wipes suitable for use in conjunction with particular embodiments of the present invention.
Figure 2A:
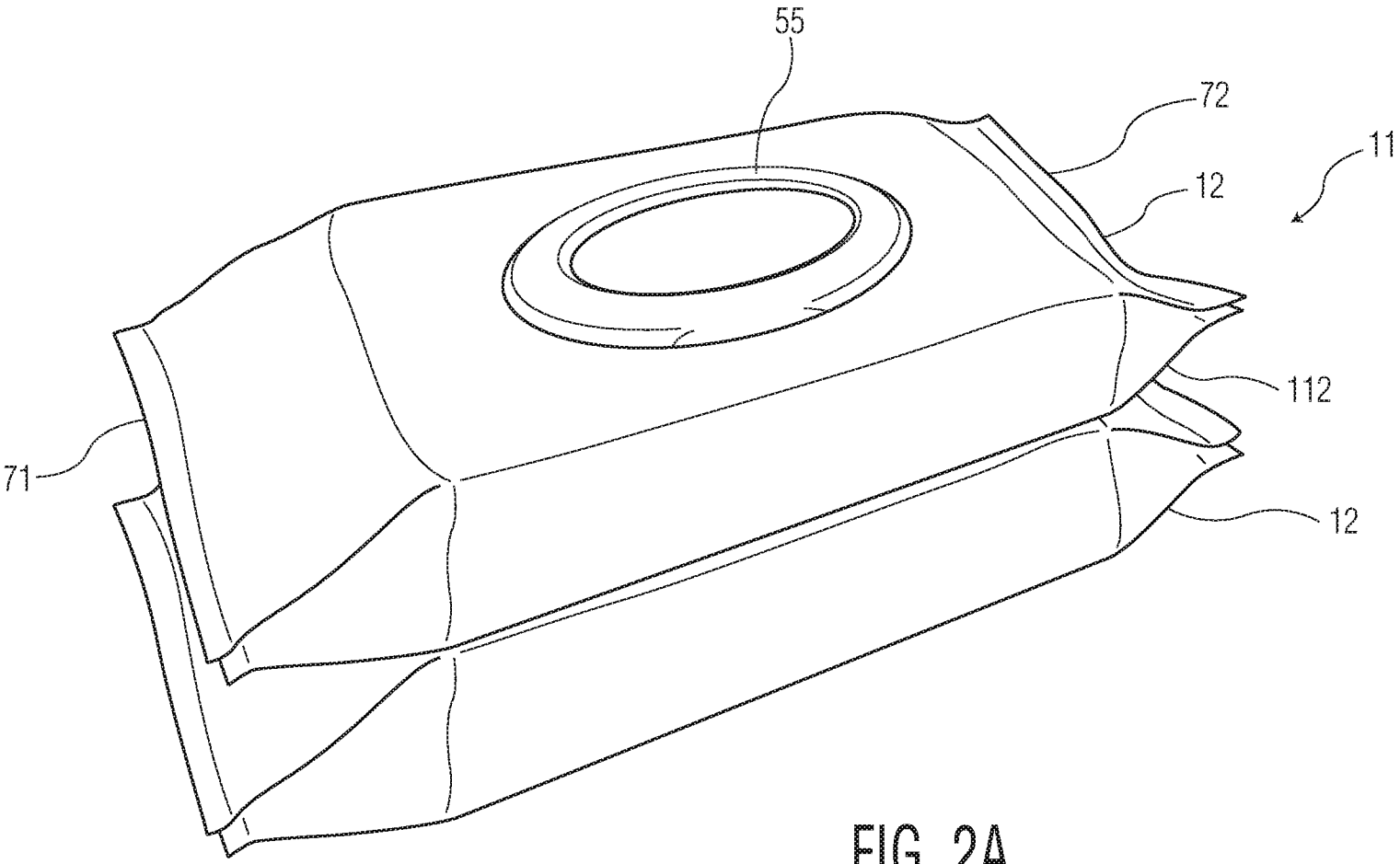
FIG. 2A representatively illustrates a stack of two packages of wipes suitable for use in conjunction with particular embodiments of the present invention.
Figure 2B:
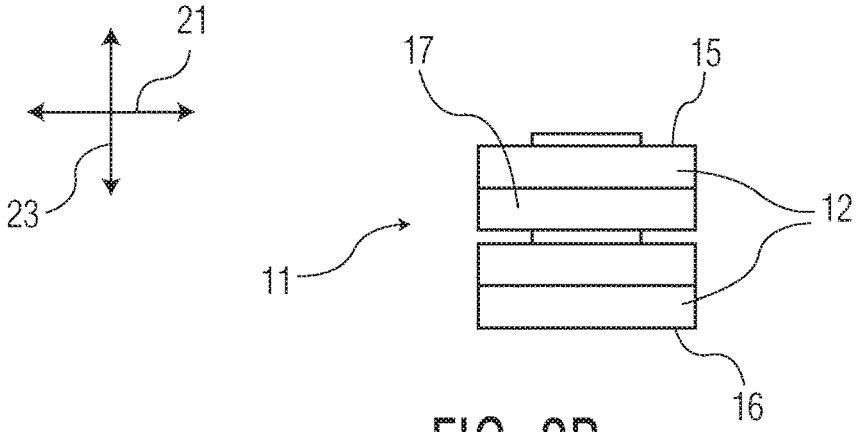
FIG. 2B representatively illustrates an end view of the stack of FIG. 2A.
Figure 2C:
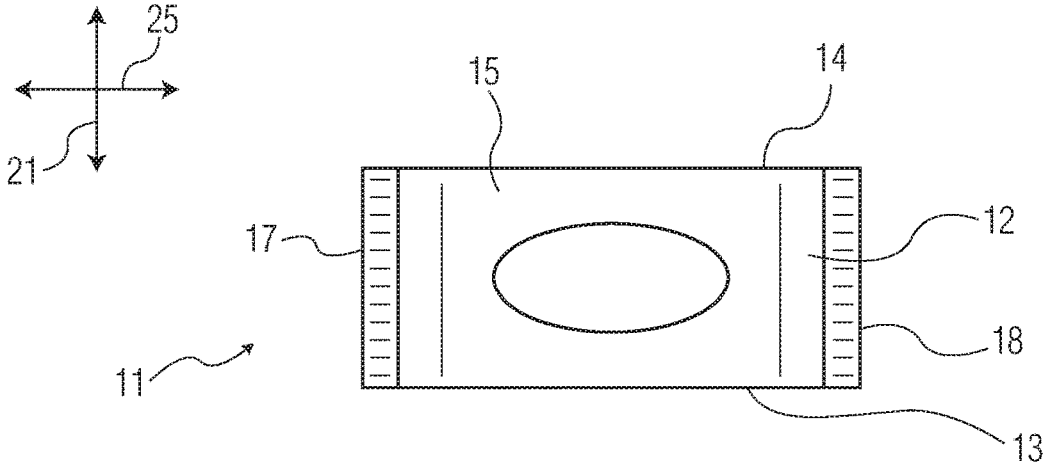
FIG. 2C representatively illustrates a top view of the stack of FIG. 2A.
Figure 2D:
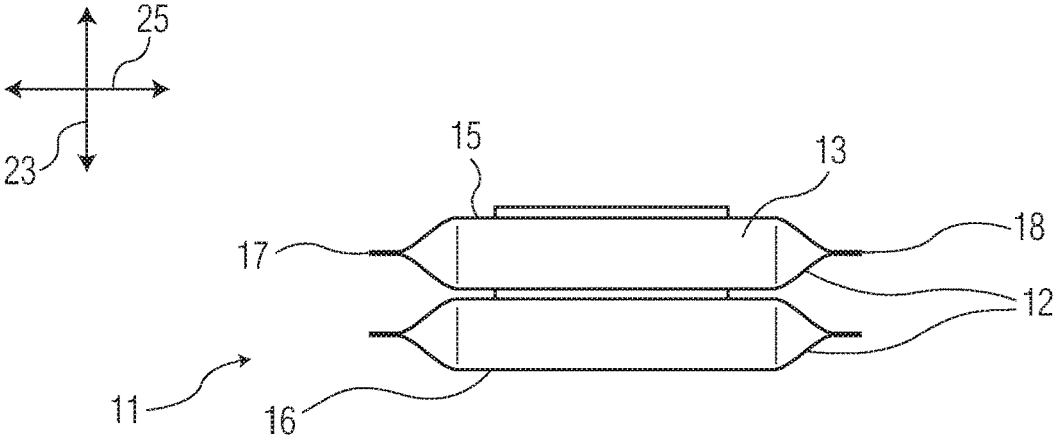
FIG. 2D representatively illustrates a front view of the stack of FIG. 2A.

In particular embodiments, each consumer product 12 is an individually wrapped, sealed package of moist wipes, such as the package representatively illustrated in FIG. 1. In the example of FIG. 1, each package 12 of moist wipes is a flow-wrap package having opposite end seals 71, 72. In particular embodiments of the invention, each end seal 71, 72 of each package of moist wipes is concealed by an end-cap 40, 42. Such a configuration can be desirable because the end seals 71, 72 may be unsightly, disheveled, or wrinkled, and concealing such aspects can deliver a more tailored, neat shelf appearance of the bundle 10.

In particular embodiments, each package 12 of moist wipes includes a rigid lid 55 that covers a dispensing orifice (not shown). The bridge 44 defines in particular embodiments a cut-out region 46 adapted to reveal the rigid lid 55. In this way, a prospective purchaser can readily see that the package 12 is of the "rigid lid" variety.

In particular embodiments, the rigid substrate used to make the bundling member 10 is cardboard, cardstock, or corrugate. In particular embodiments, the rigid substrate has a Taber stiffness of at least 40 grams/centimeter, more particularly at least 150 grams/centimeter, and more particularly at least 250 grams/centimeter, as measured in the machine direction.

In particular embodiments, a transparent, flexible film (not shown) is at least partially wrapped around the bundle. This can help secure the bundling member about the stack 11. In particular embodiments, the film covers four, and only four, of the stack's front, back, top, bottom, first end, and second end faces. In particular embodiments, the film covers at least a portion of each of the stack's front, back, top, bottom, first end, and second end faces.

While the invention has been described in detail with respect to the specific aspects thereof, it will be appreciated that those skilled in the art, upon attaining an understanding of the foregoing, may readily conceive of alterations to, variations of, and equivalents to these aspects.

What is claimed is:

1. A bundle of at least two consumer products, the bundle having a depth extending in a depth dimension, a height extending in a height dimension, and a length extending in a length dimension, the bundle comprising:

a stack of at least two individually wrapped, sealed package of moist wipes comprising a rigid lid that covers a dispensing orifice, the stack having opposite front and back faces spaced apart in the depth dimension, opposite top and bottom faces spaced apart in the height dimension, and opposite first and second end faces spaced apart in the length dimension; and a first end-cap having a first end-segment superposed over the first end face, a first front-face-segment superposed over the front face, a first back-face-segment superposed over the back face, and a first bottom-face-segment superposed over the bottom face, wherein the first front-face-segment, the first back-face-segment, and the first bottom-face-segment each extend integrally from the first end-segment, wherein the first end-segment at least partially covers the first end face, wherein the first front-face-segment has a length that extends in the length dimension and that is less than half of the bundle length;

wherein the first back-face-segment has a length that extends in the length dimension and that is less than half of the bundle length;

wherein the first bottom-face-segment has a length that extends in the length dimension and that is less than half of the bundle length;

a second end-cap having a second end-segment superposed over the second end face, a second front-face-segment superposed over the front face, a second back-face-segment superposed over the back face, and a second bottom-face-segment superposed over the bottom face, wherein the second front-face-segment, the second back-face-segment, and the second bottom-face-segment each extend integrally from the second end-segment, wherein the second end-segment at least partially covers the second end face, wherein the second front-face-segment has a length that extends in the length dimension and that is less than half of the bundle length;

wherein the second back-face-segment has a length that extends in the length dimension and that is less than half of the bundle length;

wherein the second bottom-face-segment has a length that extends in the length dimension and that is less than half of the bundle length; and a bridge defining a cut-out region adapted to reveal the rigid lid and that connects the first and second end-caps and that is superposed over the top face, wherein the first end-cap, the second end-cap, and the bridge are all integrally formed from a rigid substrate, wherein the first end-cap is not connected to the second end-cap other than by the bridge.

2. The bundle of claim 1 wherein each package of moist wipes is a flow-wrap package having opposite end seals, and wherein each end seal of each package of moist wipes is concealed by an end-cap.

3. The bundle of claim 1 wherein the first front-face-segment length, the first back-face-segment length, the first bottom-face-segment length, the second front-face-segment length, the second back-face-segment length, and the second bottom-face-segment length are each less than one quarter of the bundle length.

4. The bundle of claim 1 wherein the first end-segment completely covers the first end face, and wherein the second end-segment completely covers the second end face.

5. The bundle of claim 1 wherein the rigid substrate is cardboard, cardstock, or corrugate.

6. The bundle of claim 1 wherein no part of the bridge is superposed over the front face, the back face, or the bottom face.

7. The bundle of claim 1 wherein a transparent, flexible film is at least partially wrapped around the bundle.

8. The bundle of claim 7 wherein the film covers four, and only four, of the stack's front, back, top, bottom, first end, and second end faces.

9. The bundle of claim 7 wherein the film covers at least a portion of each of the stack's front, back, top, bottom, first end, and second end faces.

10. The bundle of claim 1 wherein the first end-segment is generally rectangular and defines a first front-edge, a first back-edge, a first bottom-edge, and a first top-edge, wherein the first front-face-segment is connected to the first end-segment along an entirety of the first front-edge, wherein the first back-face-segment is connected to the first end-segment along an entirety of the first back-edge, and wherein the first bottom-face-segment is connected to the first end-segment along an entirely of the first bottom-edge, wherein the second end-segment is generally rectangular and defines a second front-edge, a second back-edge, a second bottom-edge, and a second top-edge, wherein the second front-face-segment is connected to the second end-segment along an entirety of the second front-edge, wherein the second back-face-segment is connected to the second end-segment along an entirety of the second back-edge, and wherein the second bottom-face-segment is connected to the second end-segment along an entirely of the second bottom-edge.

11. The bundle of claim 10 wherein each front-face-segment includes two lines of weakness oriented at approximately 45 degrees to the respective front-edge, and wherein each back-face-segment includes two lines of weakness oriented at approximately 45 degrees to the respective back-edge, each line of weakness adapted to allow the respective front-face-segment or back-face-segment to collapse in upon the respective end-segment when the package of moist wipes are not present.

12. The bundle of claim 1 configured such the bottom face is adapted to face a store shelf and the front face is adapted to face a consumer during retail presentation in a store.

* * * * *